US005219456A

United States Patent [19]

Theriot

[11] Patent Number: 5,219,456

[45] Date of Patent: Jun. 15, 1993

[54] WELL TEST BURNER

[76] Inventor: Joseph G. Theriot, P.O. Box 80456, Lafayette, La. 70598

[21] Appl. No.: 858,882

[22] Filed: Mar. 27, 1992

[51] Int. Cl.[5] ..... F23D 14/62

[52] U.S. Cl. ..... 431/354; 239/403; 239/404

[58] Field of Search ..... 239/403, 404; 431/158, 431/173, 278, 354

[56] References Cited

U.S. PATENT DOCUMENTS

| | | | |
|---|---|---|---|
| 3,045,278 | 7/1962 | Potter | 431/158 |
| 3,131,037 | 4/1964 | Backstrom et al. | 431/403 |
| 3,811,820 | 5/1974 | Theriot | 431/354 |

*Primary Examiner*—Carroll B. Dority
*Attorney, Agent, or Firm*—Keaty & Keaty

[57] ABSTRACT

An oil well test burner provides for the use of a hollow body which defines a mixing chamber therein. A plurality of openings are formed in the body in communication with interior chamber for delivering oil and air into the interior chamber in such a manner, that an opening delivering oil into the chamber is disposed diametrically opposite at least one other opening which delivers air into the chamber. A pair of manifolds delivers oil and air, respectively, through a plurality of a corresponding number of emanating conduits which are attached to the body in a surrounding relationship to a respective opening in the body. Each manifold is provided with a flow regulating valve downstream from the conduits.

4 Claims, 1 Drawing Sheet

WELL TEST BURNER

BACKGROUND OF THE INVENTION

The present invention relates to oil field equipment, and more particularly to an oil burner for testing operations for oil wells. It is a conventional practice in the oil field industry to burn a discrete amount of oil in order to test the quality of oil before starting full production operations. Various governmental laws prescribe the requirements for well test burners which would minimize the ecological dangers, while the oil is consumed.

To that end, a number of devices have been designed and used for the purpose of testing the well through burning of a discrete amount of oil, one of the patented devices being U.S. Pat. No. 3,811,820 issued on May 21, 1974. In U.S. Pat. No. '820 the burner required that an internal valve in the form of a lance be positioned within a hollow cylindrical body to regulate and vary the discharge of oil and air mist through the open end of the body, the mist being ignited by an external ignition source to form a smokeless flame.

While this device functioned successfully for many years, the most recent tests have shown that it is possible to regulate the amount of discharged oil and air mist without the internal valve, by regulating the flow of oil and air from their respective manifolds.

The present invention contemplates provision of an improved well test burner which is easy to operate and less expensive to manufacture.

SUMMARY OF THE INVENTION

It is, therefore, a general object of the present invention to provide an improved oil well test burner.

It is another object of the present invention to provide a well test burner which has less moving parts and is easy to operate.

It is a further object of the present invention to provide a well test burner which is inexpensive to manufacture.

It is still a further object of the present invention to provide a well test burner which is capable of consuming oil in an efficient manner without jeopardizing the quality of the operation and endangering the environment.

These and other objects of the present invention are achieved through a provision of an oil well test burner which comprises a hollow body defining an interior mixing chamber therein. The body has a first end closed by an end plate and a second end which is partially closed by a plate provided with a central opening therein. The second end plate has a conically shaped opening which converges inwardly and communicates with the mixing chamber through a restricted size opening.

A plurality of laterally spaced openings are made in the body in fluid communication with the interior chamber, the openings being laterally spaced from each other in such a manner, that each of said openings is positioned diametrically opposite to at least one other opening.

A first manifold delivers a regulated flow of oil into the mixing chamber through a plurality of conduits, each conduit being connected to a respective oil delivering opening. A second manifold delivers air into the interior chamber through a plurality of a second set of a corresponding number of air delivering conduits. The plurality of generated oil streams are impinged by a plurality of generated air streams within the mixing chamber to form an intimate mixture of oil and air and produce an oily mist forced outside of the mixing chamber through the conical opening made in the second end plate. The mixture is ignited by an ignition means to cause a smokeless burnout of the tested oil.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
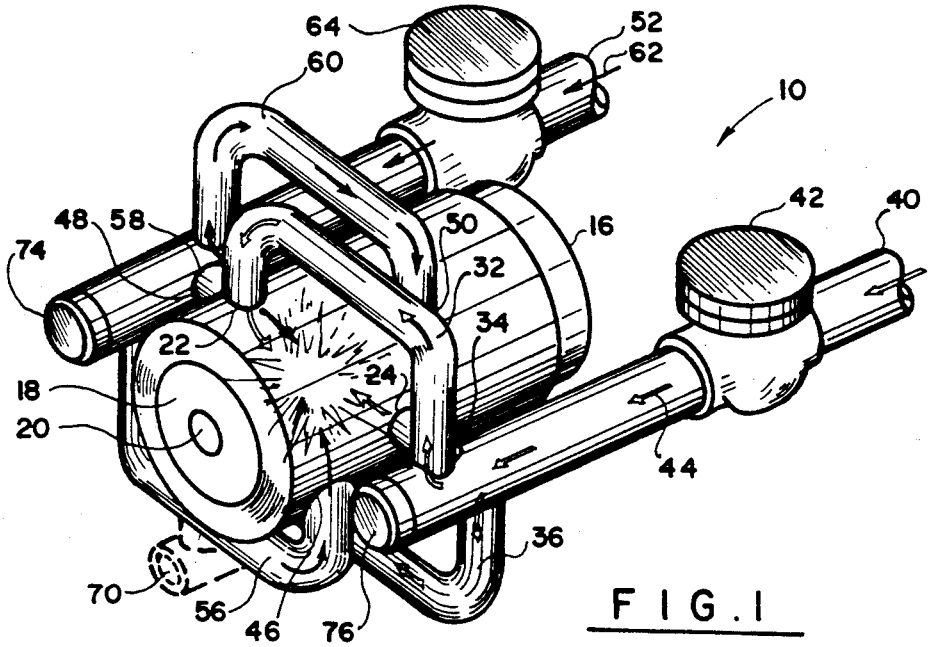
FIG. 1 is a perspective view of the well test burner in accordance with the present invention.
Figure 2:
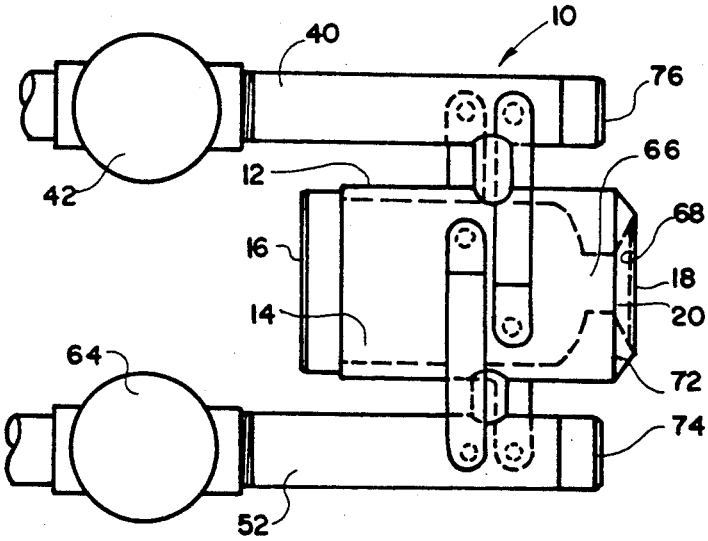
FIG. 2 is a plan view of the apparatus shown in FIG. 1.

Referring now to the drawings in more detail, numeral 10 designates the well test burner in accordance with the present invention. The burner 10 comprises an elongated hollow body 12, the internal walls of which define an interior mixing chamber 14. The body 12 is closed at one of its ends by an end plate 16, and is partially closed by an end plate 18 on its opposite end.

The plate 18 has a central opening 20 therein the opening 20 fluidly communicating with the interior chamber 14 and allowing a forceful discharge of the oil and the air outside of the housing 12.

A plurality of openings 22, 24, and 26 are made in the body 12 for admitting air into the chamber 14 from respective air conduits 32, 34, and 36, respectively. The air is supplied to the conduits 32, 34 and 36 through an air manifold 40. The flow of air is regulated by a check valve 42 mounted downstream from the conduits 32, 34, and 36. The air flow is directed towards the chamber 14 along the path shown in the direction of arrows 44.

Three more openings 46, 48, and 50 are formed in the body 12 in fluid communication with the interior chamber 14 to allow communication between the chamber and an oil manifold 52 through their respective oil delivering conduits 56, 58, and 60. The oil is forced through the manifold 52 in the direction of arrows 62. The flow of oil is suitably regulated by a check valve 64 mounted downstream from the conduits 56, 58, and 60 on the manifold 52.

Figure 3:
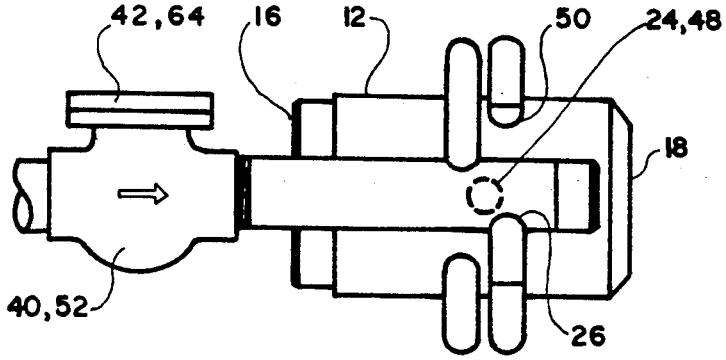
FIG. 3 is a side view of the well test burner shown in FIGS. 1 and 2.

As will be appreciated, the oil and air are introduced into the chamber 14 through their respective openings in diametrically opposite fashion, such that the oil particles are broken into tiny particles to form a fine mist of oil mixed with air before the mixture is discharged through the opening 20 in the end plate 18. It should be also noted that the central axes of the openings which admit oil into the chamber 14 are diametrically opposite to the axes of the opening which admit air into the chamber 14, while each pair of diametrically opposed openings is laterally spaced from another pair along the body 12. As a result, the opening 22 is diametrically opposite to the opening 46 and is longitudinally spaced from the openings 48 and 24. The opposite pair of openings 26 and 50 is further spaced from the openings 24 and 48, as can be better seen in FIG. 3.

The chamber 14 has a restricted diameter portion 66 which is in fluid communication with the chamber 14 and with the opening 20 through a conical cut out 68 formed in the end 72 of the body 12.

A suitable ignition means 70 is mounted below the body 12 in a generally co-planar relationship to the end plate 18 for igniting the oily mist which is forced through the opening 20 outside of the housing 12. The ignition means 70 can be ignited by any suitable means known in the art, such as spark plug, transformer, and the like. The intimate mixture of oil and air created during the mixing process within the chamber 14 allows for a virtually smokeless burnup of the oil disposed of after the well testing operation.

In practice, the apparatus 10 can be positioned on an elongated boom which supports the apparatus 10 at a distance from the well being tested to prevent damage to the well itself.

In operation, the flow of oil is introduced into the mixing chamber 14 through the manifold 52, with the amount of oil being regulated by a check valve 64. With the upstream end of the manifold 52 being closed by a weld cap 74, the oil is forced in the chamber 14 through the conduits 58, 60, and 56 under a predetermined pressure.

Simultaneously, a flow of air is forced through the manifold 40, with the flow being regulated by the check valve 42. With the downstream end of the manifold 40 being closed by a weld cap 76, the air is forced through the conduits 32, 34, and 36 into the interior chamber 14 at a pre-determined pressure rate.

As was mentioned above, one half of the laterally-spaced openings (which admits oil into the chamber 14) is positioned diametrically opposite the second half of the openings, which admits air into the chamber 14. As a result, each stream of oil delivered through a conduit into the chamber 14 is impinged against a flow of air delivered through a diametrically opposite opening, forming a misty mixture of oil and air within the interior mixing chamber 14.

Since the first end of the housing 12 is closed by an end plate 16, the mixture is forced through the restricted diameter opening 66, through the conically shaped opening 68 and outside through the opening 20 in the plate 18. The escaping mixture is ignited by the ignition means 70 and is burned for complete disposal of the tested amount of oil.

Many changes and modifications can be made within the design of the present invention without departing from the spirit thereof. I, therefore, pray that my rights to the present invention be limited only by the scope of the appended claims.

I claim:

1. An oil well test burner, consisting of:

a hollow body defining an interior chamber therein, said body having a first closed end and a second, partially closed end;

said second end defining an inwardly converting conical opening, said opening fluidly communicating with the interior chamber;

a plate covering an outer end of said inwardly converting conical opening and a central opening in said plate;

a plurality of laterally spaced openings formed in said body in fluid communication with said interior chamber;

means for delivering oil into the interior chamber through one half of said laterally spaced openings; and means for delivering air into the interior chamber through the second half of said laterally spaced openings, so as to cause intimate mixing of oil and air inside the chamber and discharge of that formed mixture outside of the interior chamber through said conical opening.

2. The burner of claim 1, wherein said oil delivering means comprises an elongated manifold provided with flow regulating means and a plurality of conduits emanating from said manifold upstream from said flow regulating means, each of said conduits being connected to a corresponding oil admitting opening in said body.

3. The burner of claim 1, wherein said air delivering means comprises an elongated manifold provided with flow regulating means and a plurality of conduits emanating from said manifold upstream from said flow regulating means, each of said conduits being connected to a corresponding air admitting opening in said body.

4. The well test burner of claim 1, further comprising means for igniting the formed mixture mounted exteriorly of said body.

* * * * *